US005305578A

United States Patent [19]

Menayan

[11] Patent Number: 5,305,578

[45] Date of Patent: Apr. 26, 1994

[54] HEAT-SHRINKABLE BAND APPLICATION MACHINE

[75] Inventor: Victor V. Menayan, Cary, N.C.

[73] Assignee: Axon Corporation, Garner, N.C.

[21] Appl. No.: 31,314

[22] Filed: Mar. 15, 1993

[51] Int. Cl.[5] ..... B65B 9/10

[52] U.S. Cl. ..... 53/399; 53/292; 53/567; 53/585

[58] Field of Search ..... 53/291, 292, 567, 585, 53/399, 459, 442, 557, 313, 315, 316

[56] References Cited

U.S. PATENT DOCUMENTS

| | | | |
|---|---|---|---|
| 2,976,661 | 3/1961 | Bagnelle | 53/585 X |
| 3,888,067 | 6/1975 | Cross et al. | 53/292 |
| 4,184,309 | 1/1980 | Amberg | 53/585 X |
| 4,293,364 | 10/1981 | Fujio | 53/585 X |
| 4,914,893 | 4/1990 | Strub et al. | 53/585 X |
| 5,070,680 | 12/1991 | Nagano | 53/585 X |
| 5,101,613 | 4/1992 | Wilhelm et al. | 53/292 X |

*Primary Examiner*—John Sipos
*Assistant Examiner*—Linda B. Johnson
*Attorney, Agent, or Firm*—Rhodes, Coats & Bennett

[57] ABSTRACT

A band application machine for transferring to containers heat-shrinkable bands. The band application machine includes a band feed system for feeding band supply material to a cutting system which cuts a band from the band supply. A transfer system transfers cut bands to containers conveyed past a banding point, and includes a band gripping mechanism and a plunger. Band gripping mechanism includes opposed suction cups that are movably mounted for gripping and positioning a cut band. The suction cups are laterally movable from a position where a closed band is gripped on opposing sides by the suction cups to a position where the band is open and aligned with the stroke of the plunger. The plunger is positioned over the opened band at an angle with respect to the band. The plunger presses and drives the band onto a container as the gripper apparatus releases the open band. The angle of the top plunger with respect to the cut band results in the plunger engaging a leading edge of the cut band as the plunger moves to press the band onto the underpassing container. Associated with the plunger are air blast openings that direct air against an inside, trailing section of the band so as to effectively urge and maintain the band in an open position as the plunger presses the band onto the container. A programmable control system directs the operation of the band application machine.

24 Claims, 8 Drawing Sheets

HEAT-SHRINKABLE BAND APPLICATION MACHINE

FIELD OF THE INVENTION

The present invention relates to machines for applying heat-shrinkable bands to containers, and more particularly to a method and apparatus for precisely positioning bands onto containers being conveyed past a band application point.

BACKGROUND OF THE INVENTION

One problem faced by engineers and designers of band application machines is that of designing a machine capable of accommodating both small and large diameter bands and bands having depths of various lengths. In particular, a band application machine includes a transfer mechanism capable of repeatedly transferring cut bands to containers passing a band application point. Transfer mechanisms of prior art machines are typically designed to only handle a very limited size range of bands. Thus, versatility and effectiveness of prior art band application machines are severely limited due to their inability to handle a wide range of different size bands. For example, a business needing to place different size bands on containers may have to purchase several band application machines to handle the different sized bands. Likewise, a business with a single type of machine may have to redesign or rework a machine if they decide to apply different size bands to containers.

There is a great need for a versatile machine that can apply a variety of different size bands to containers without the need to rework or redesign the machine.

SUMMARY AND OBJECTS OF THE INVENTION

The present invention has been designed to overcome the problems of prior art banding machines discussed above. More particularly, the band application machine of the present invention includes a transfer mechanism capable of transferring to containers both small and large diameter bands and bands having depths of various lengths.

Briefly reviewing the structure of the present invention, the band application machine of the present invention includes a transfer mechanism having a cut band gripping mechanism. The band gripping mechanism includes suction cups that are movable mounted. The suction cups are laterally moveable from a position where a closed band is gripped on opposing sides to a position where the band is open and laterally aligned with the stroke of a plunger positioned above the band. The ability of the transfer mechanism to grip the band on opposing sides and to laterally position the band enables the machine to handle a wide range of different size bands.

The plunger is positioned over the opened band at an angle with respect to the band. The plunger presses and drives the band onto a container as the band gripping mechanism releases the open band. The angle of the top plunger with respect to the cut band results in the plunger engaging a leading edge of the cut band as the plunger moves to press the band onto the under passing container. Associated with the plunger is an air blast means that directs air against an inner trailing section of the band as the plunger presses the band onto the container so as to effectively urge and maintain the band in an open position.

Accordingly, it is an object of the present invention to provide a band application machine capable of handling small and large diameter bands and bands having depths of various lengths.

Another object of the present invention is to provide a band application machine that consistently applies bands to containers.

Another object of the present invention is to provide a band application machine that can precisely handle a wide range of different size bands and transfer the bands to containers.

Another object of the present invention is to provide a band application machine that is easily adjustable to allow application of a wide range of different size bands without extensive redesigned or reworking of the machine.

Another object of the present invention is to provide a band application machine that is versatile, easy to use, and easy to maintain.

Other objects and advantages of the present invention will become apparent and obvious from a study of the following description and the accompanying drawings which are merely illustrative of such invention.

DETAILED DESCRIPTION OF THE INVENTION

Figure 1:
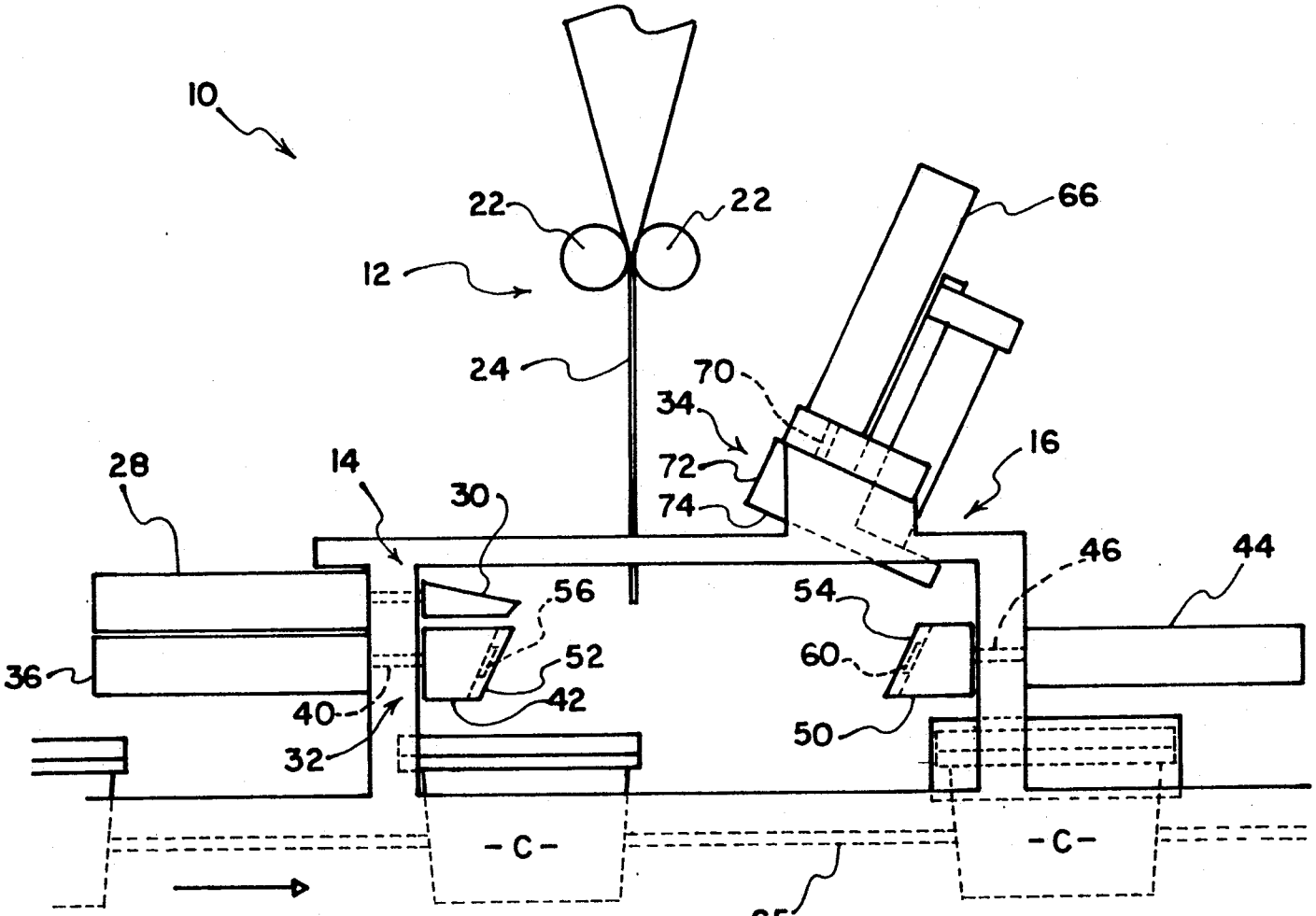
FIGS. 1–5 are a sequence of side views of the band application machine showing the band transfer system applying a band to a container.

The present invention relates to an improved machine for applying heat-shrinkable bands to containers. Machines for applying heat-shrinkable bands are well-known in the prior art and are used throughout the world for applying cut, tamper-evident bands and labels to a wide variety of containers. Therefore, in describing the band application machine of the present invention, it will be appreciated that much of the structure and function of the machine is conventional. For that reason, a detailed description of the entire machine will not be dealt with herein. For a more complete and unified understanding of band application machines and the general state of the art, one is referred to U.S. Pat. Nos. 5,165,215; 4,914,893; 2,623,673; 2,751,735; and 3,802,152; the disclosures of each being expressly incorporated herein by reference.

Now turning to the present invention, it should first be noted that the present invention is directed to a band transfer system of a band application machine, where the band transfer system transfers cut bands from a cutting site to underlying passing containers.

With further reference to the drawings, the machine for applying bands is indicated generally by the numeral 10. Band application machine 10 includes four basic systems, a feed system 12, a cutting system 14, a band transfer system 16, and a control system 20. Briefly viewing each of the systems before proceeding with the detailed description of the invention, it should be pointed out that the feed system 12 functions to direct and advance an elongated, supply strip of band material 24 to the cutting system 14. Cutting system 14 cuts the supply strip 24 into individual cut bands 24a that are ultimately applied to containers. Once cut, each cut band 24a is engaged by the band transfer system 16. Band transfer system 16 functions to grasp the cut band 24a and to position the same for an efficient transfer onto a passing container C. All of the aforementioned systems are connected to and controlled by a conventional control system 20. (See FIG. 7)

Feed system 12 includes a pair of feed rollers 22 and a step motor (not shown) for selectively rotating feed rollers 22. Supply strip 24 is threaded through feed rollers 22 and is gripped therebetween. By rotating feed rollers 22, a selected length of supply strip 24 is fed to cutting system 14.

Cutting system 14 is disposed below feed rollers 22 and functions to cut the supply strip 24 being fed downwardly from feed rollers 22. Cutting system 14 includes a blade 30 that is connected to an air cylinder 28 and is moveable between a retracted position shown in FIG. 1 and an extended position shown in FIG. 2. Blade 30 cuts supply strip 24 to produce a cut band 24a as blade 30 moves from the retracted position to the extended position.

Transfer system 16 functions to grasp the cut band 24a and to effectuate transfer of the cut band 24a onto an underlying, passing container C that is disposed on a conveyor system 65.

Reviewing band transfer system 16 in more detail, the same includes a band gripping mechanism 32 and a plunger 34. Band gripping mechanism 32 functions to grip and open the cut band 24a, while also laterally positioning the cut band 24a beneath plunger 34. Plunger 34 functions to press the cut band 24a onto passing container C.

Band gripping mechanism 32 includes a first gripper cylinder 36 having a suction-cup block 42 attached to the cylinder's piston 40. Band gripping mechanism 32 also includes a second gripper cylinder 44 which opposes first gripper cylinder 36. Second gripper cylinder 44 also includes a suction-cup block 50 connected to the piston 46 of gripper cylinder 44. Opposing gripper cylinders 36 and 44 each have an angled block face, 52 and 54 respectively. In the preferred embodiment, block faces 52 and 54 are parallel to one another and are disposed at approximately a 25°-30° angle. Block faces 52 and 54 each have a suction cup, 56 and 60 respectively, attached thereto. Suction cups 56 and 60 are connected to a vacuum source (not shown) that draws air through the suction cups 56 and 60 to produce a vacuum securing the cut band 24a to suction cups 56 and 60 when cut band 24a is positioned against suction cups 56 and 60. Once the cut band 24a has been grasped by suction cups 56 and 60, gripper cylinders 36 and 44 are selectively actuated to open cut band 24a and position band 24a beneath plunger 34.

In the preferred embodiment, block faces 52 and 54 each have only a single suction cup 56 and 60 respectively. However, in an alternative embodiment of the present invention, a plurality of spaced suction cups can be provided on each block face 52 and 54 so that the suction cups grasp a band along multiple points on each side of the band. Gripping a cut band with a plurality of suction cups along opposing sides provides more effective handling of large diameter bands or deep bands.

As discussed above and shown in FIGS. 1-5, plunger 34 functions to press cut band 24a, positioned beneath it by gripping mechanism 32, onto a passing container C. In particular, plunger 34 reciprocates between a retracted position shown in FIGS. 1 and 2 to an extended position shown in FIG. 5 where plunger 34 presses cut band 24a onto a passing container C. Plunger 34 includes a plunger cylinder 66 and a plate 72 attached to piston 70 of cylinder 66. As shown in FIG. 6, plate 72 includes a plate face 74 having a pair of elongated channels 76 and an orifice 80 located within each channel 76. Orifices 80 are positioned at an acute angle with respect to the plate face 74 and are connected to a pressurized air source (not shown) that selectively forces an air blast from orifices 80. Channels 76 help direct the air blasts from orifices 80 in a direction downstream of the passing containers C.

Figure 7:
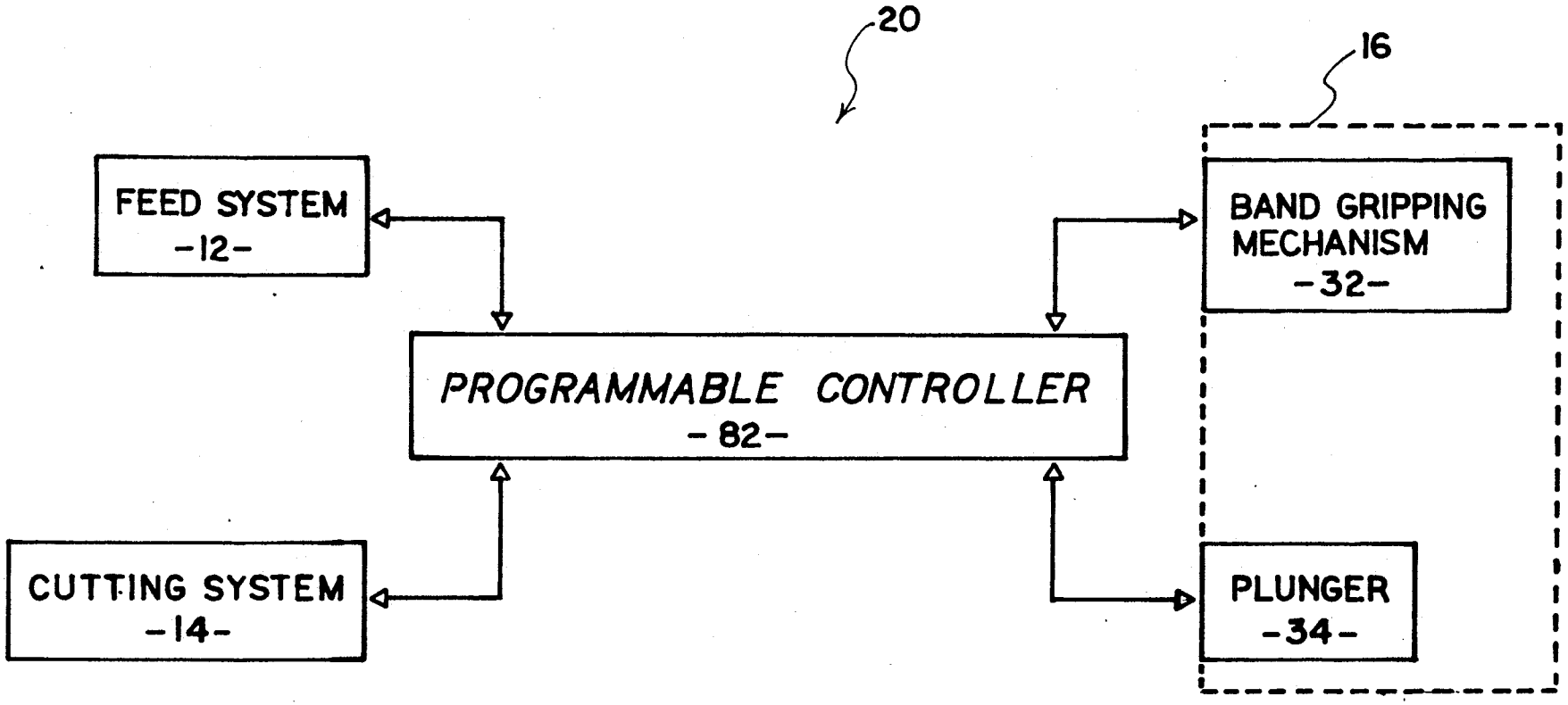
FIG. 7 is a schematic of the control system of the band application machine.

Referring to FIG. 7, it is seen that the central element of control system 20 is a programmable controller 82 connected to the feed mechanism 12, cutting mechanism 14, and transfer system 16. Controller 82 receives input from the various systems and directs the operation of feed system 12, cutting system 14 and transfer system 16. Control system 20 includes various switches connected to controller 82 for sensing selected conditions of the band application machine 10 and signalling programmable controller 82 of these selected conditions. Control system 20 will be described in more detail in the following discussion of the operation of band application machine 10.

Operation of band application machine 10 is controlled by control system 20. Band application machine 10 operates in cycles with each cycle beginning with the feeding of the supply strip 24 and ending with a complete engagement of a cut band 24a with a container C. A description of a single cycle follows.

Figure 2:
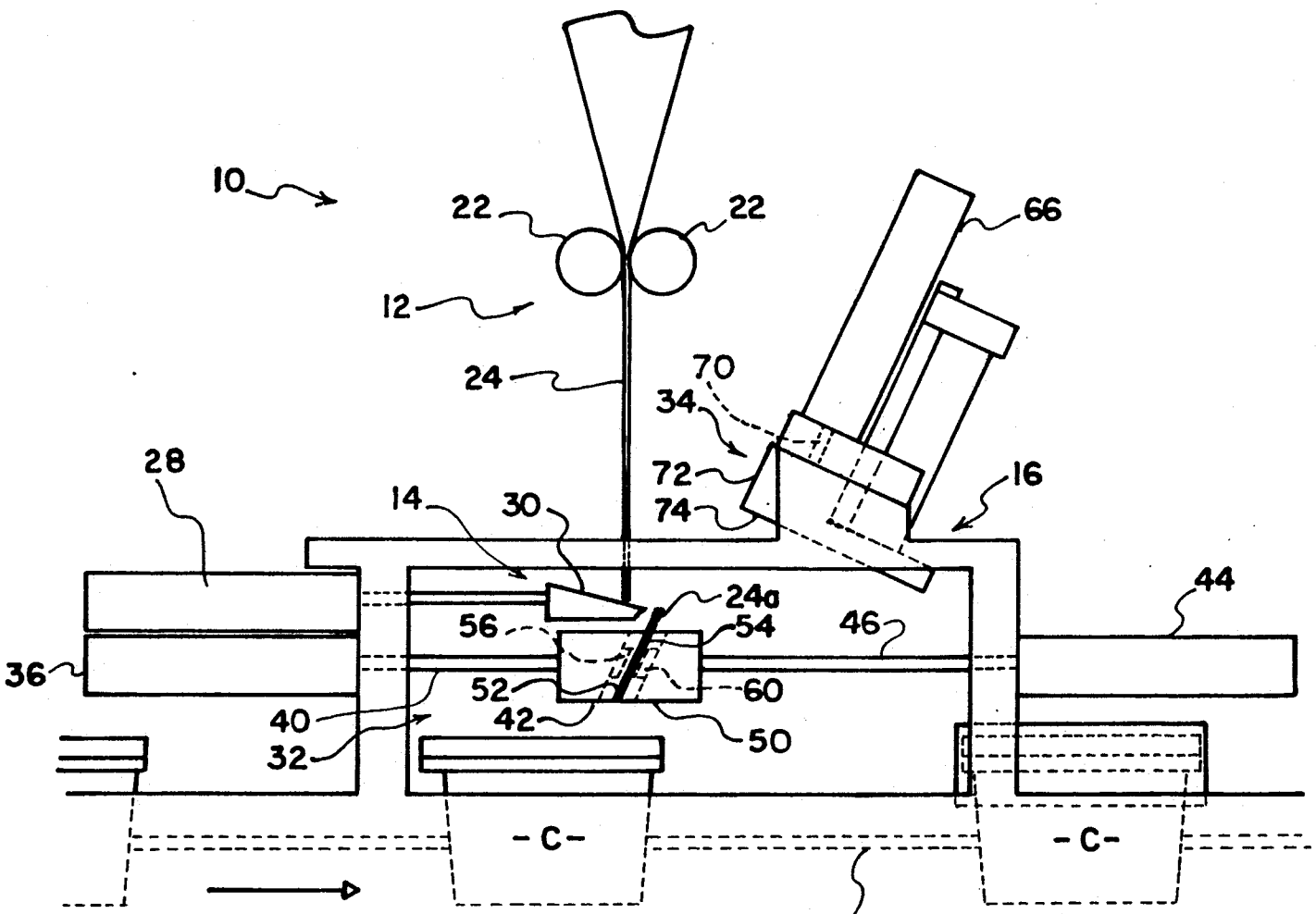

At the beginning of the cycle, band application machine 10 is positioned as shown in FIG. 1. Controller 82 signals the step motor (not shown) attached to rollers 22 to advance supply strip 24 downwardly such that a predetermined length of band material 24 extends below blade 30. Upon advancing supply strip 24 a selected distance, a sensor switch (not shown) associated with feed mechanism 12 signals controller 82 that supply strip 24 has been advanced the selected distance, and in response controller 82 directs the operation of band gripping mechanism 32 as follows. Referring to FIG. 2, gripper cylinder 44 is actuated to place piston 46 in an extended position such that suction-cup block 50 is positioned adjacent a side section of supply strip 24. When gripper cylinder 44 and its piston 46 are placed in the extended position, a sensor switch (not shown) associated with gripper cylinder 44 produces a signal representing this condition and sends this signal to controller 82. Upon receiving this signal, controller 82 directs gripper cylinder 36 to position suction-cup block 42 to a partially-extended position where suction-cup block 42 is positioned adjacent to supply strip 24 and opposing suction-cup block 50.

Upon receiving the signal that the supply strip 24 has been advanced, controller 82 also directs the vacuum source (not shown) to draw air through suction cups 56 and 60. When opposing suction-cup blocks 42 and 50 are positioned adjacent to one another as shown in FIG. 2, a vacuum is produced at suction cups 56 and 60 which causes opposing sides of cut band 24a to be gripped by suction cups 56 and 60.

As gripper cylinder 44 is placed in its extended position, a sensor switch (not shown) associated with gripper cylinder 44 signals controller 82 of this condition. Upon receiving this signal, controller 82 directs cutting mechanism 14 to extend blade 30 from its retracted position (shown in FIG. 1) to its extended position (shown in FIG. 2). As blade 30 is moved to the extended position, it crosses the path of supply strip 24 to produce the cut band 24*a*. After cutting supply strip 24, blade 30 is moved back into its retracted position.

Figure 3:
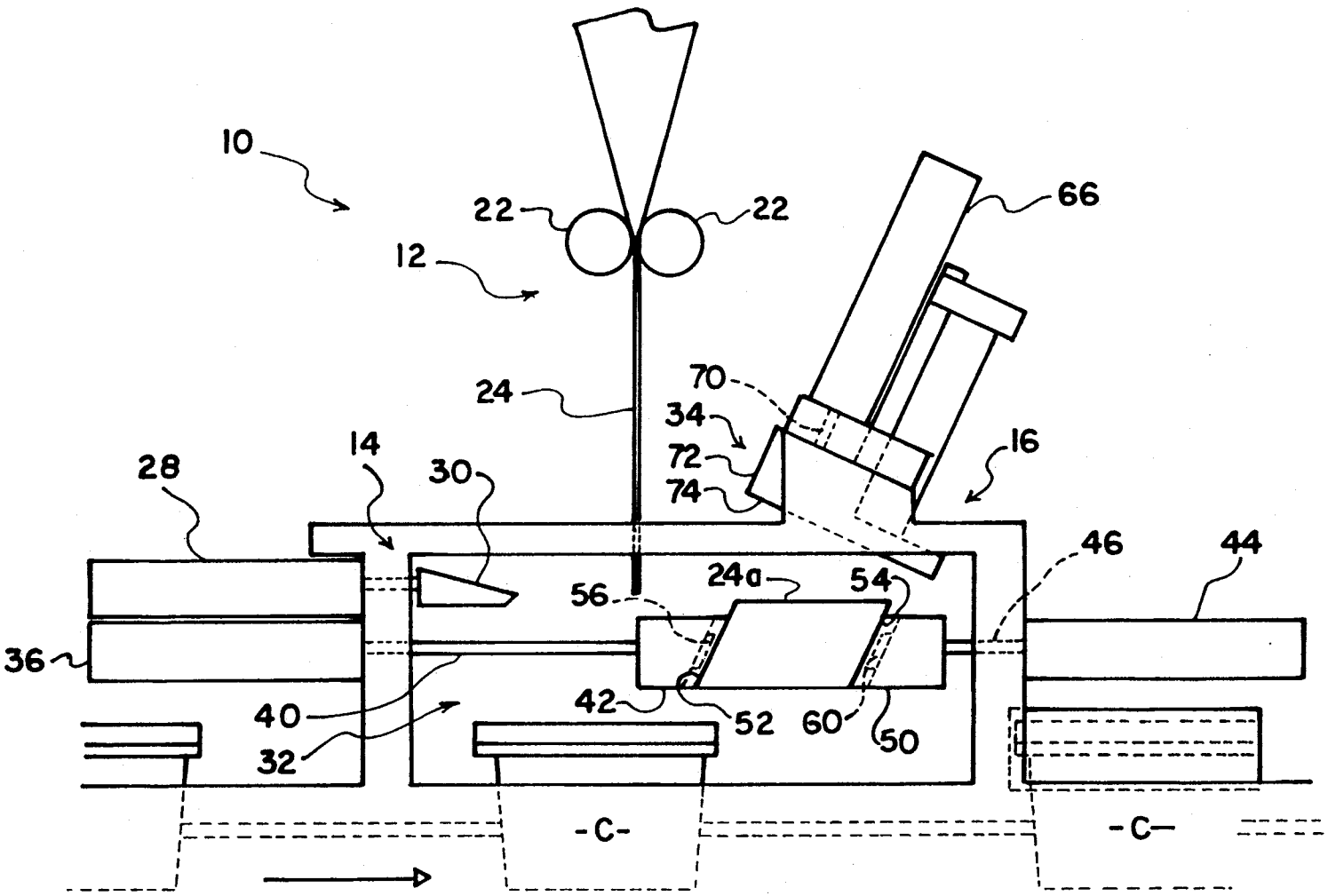

As blade 30 is moved to its extended position, a sensor switch (not shown) associated with cutting mechanism 14 signals controller 82 of this condition. Upon receiving this signal, controller 82 directs gripper cylinder 44 to move suction-cup block 50 into a retracted position which also directs gripper cylinder 36 to move suction-cup block 42 a fully extended position. As shown in FIG. 3, as gripper cylinder 44 is moved into its retracted position and gripper cylinder 36 is positioned to its fully extended position, cut band 24*a* which is gripped between block faces 52 and 54 is moved from a closed position into an open position. In addition, band 24*a* is laterally moved from a cutting and band supply area to a location beneath plunger 34. The lateral movement of band 24*a* is necessary to provide clearance for plunger 34 such that the stroke of plunger 34 is not hindered by cutting system 14 or feed system 12.

A sensor switch (not shown) associated with gripper cylinder 36 signals controller 82 when gripper cylinder 36 is moved into its fully extended position. Upon receiving this signal, controller 82 directs the vacuum source (not shown) to release the vacuum at suction cups 56 and 60 such that cut band 24*a* is released from band gripper mechanism 32. After the vacuum is released, opposing gripper cylinders 36 and 44 are directed to move into their initial retracted positions.

Figure 4:
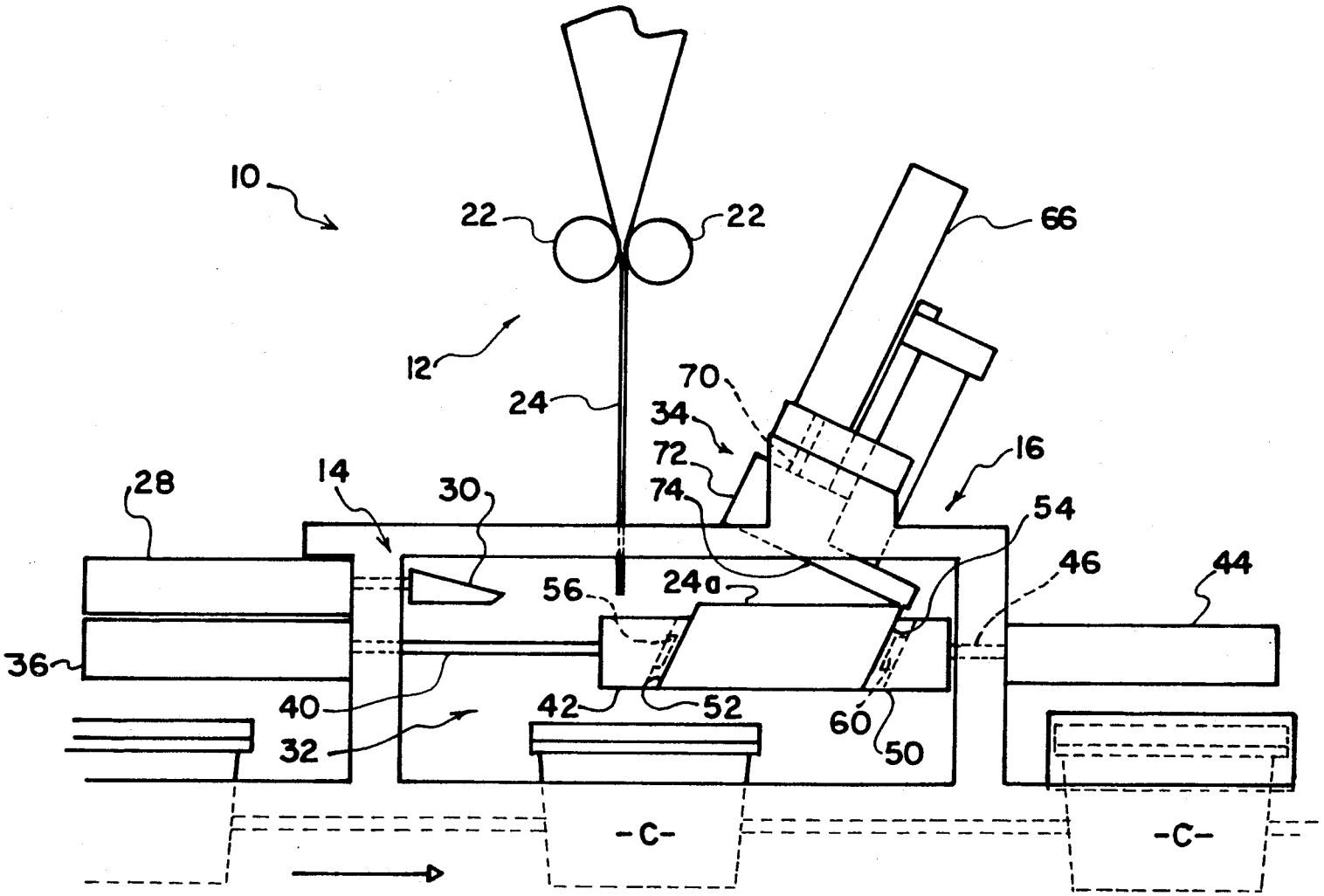

At approximately the same time that band 24*a* is released, plunger 34 is signaled to move to the extended position by a sensor switch which (not shown) is associated with conveyor system 65 and which indicates the position of container C on conveyor 65. The path of plunger 34 is aligned with the cut band 24*a* such that the band 24*a* is pressed onto container C passing below. As plate 72 moves from the retracted position to the extended position, as shown in FIG. 4, angled face 74 initially contacts the leading edge of cut band 24*a*. Band 24*a* is then pushed into an angled position corresponding to the angle of plate face 74.

Figure 5:
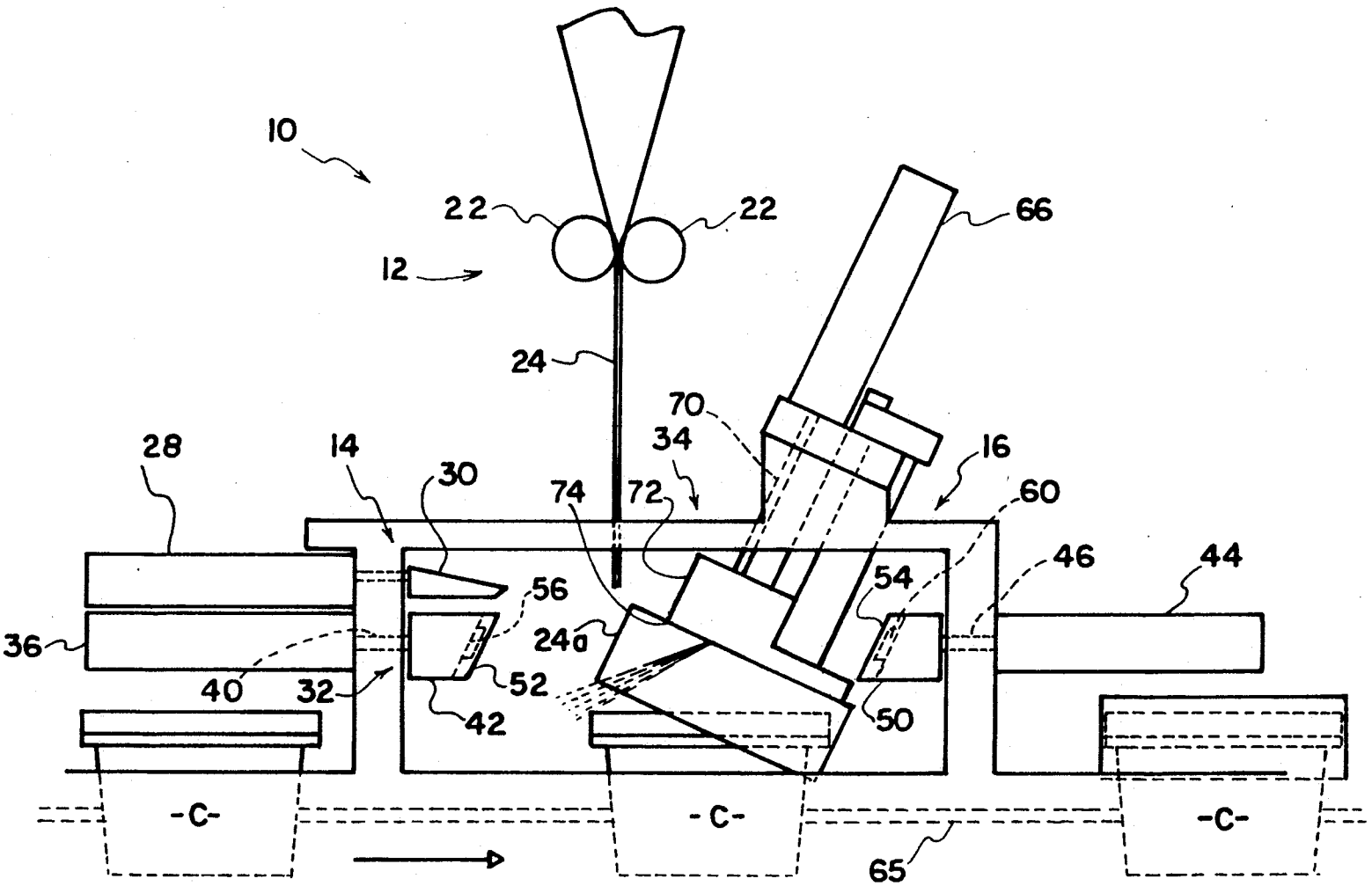
Figure 6:
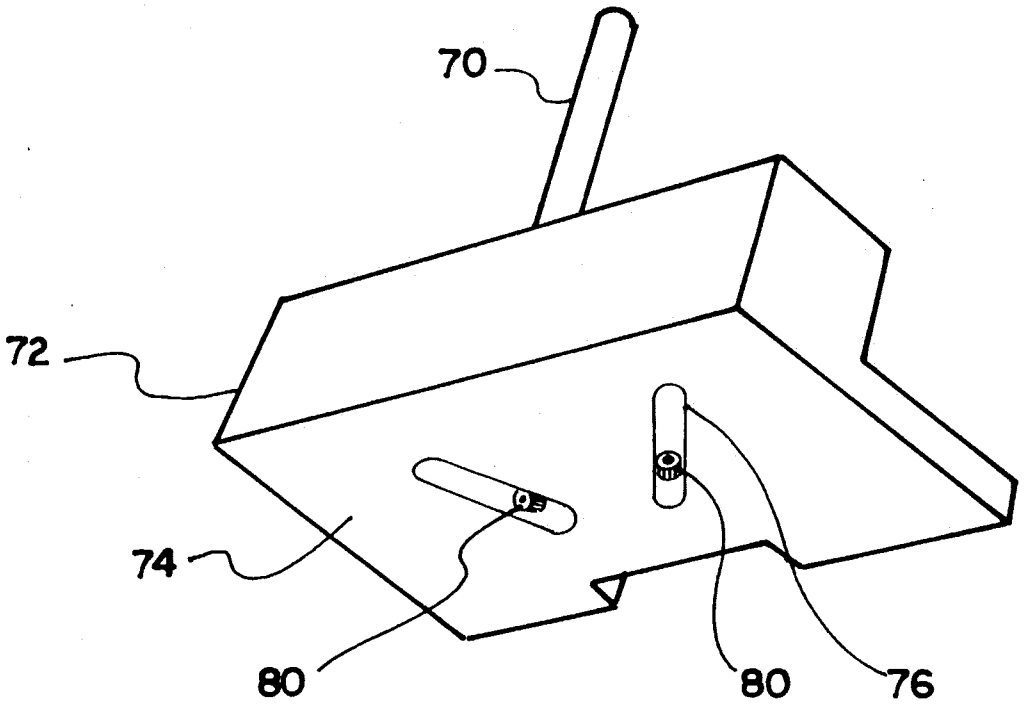
FIG. 6 is a perspective view of the plunger of the band application machine showing the plunger's air blast orifices.

As plate 72 is moved from the retracted position to the extended position, as shown in FIG. 5, the pressurized air source (not shown) also directs a blast of air through orifices 80. The blast of air is directed downwardly against an inside, trailing-edge section of cut band 24*a*. The blast of air helps force and maintain the trailing-edge section of band 24*a* in an open position to help ensure that cut band 24*a* remains in an open position and is properly positioned over container C as the plunger 34 presses cut band 24*a* onto container C. If the cut band 24*a* is not positioned properly over a container C or is inadvertently moved toward a closed position, cut band 24*a* may be pressed against the top of passing container C and not be pressed over and onto container C. The blast of air from orifices 80 helps ensure that cut band 24*a* is maintained in the open position and properly positioned. In addition, the blast of air helps ensure that the trailing edge of band 24*a* is not snagged on imperfections or irregularities on the surface of the top of container C.

Figure 5C:
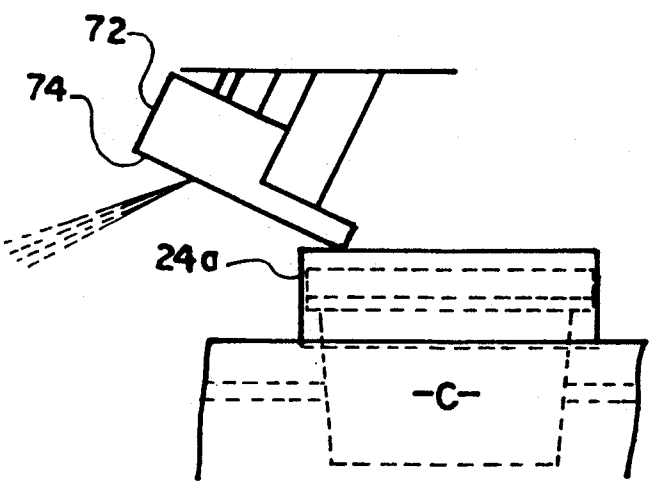
FIGS. 5A, 5B and 5C, are a sequence of views illustrating the final stages of the transfer of a cut band onto an underpassing container.
Figure 5B:
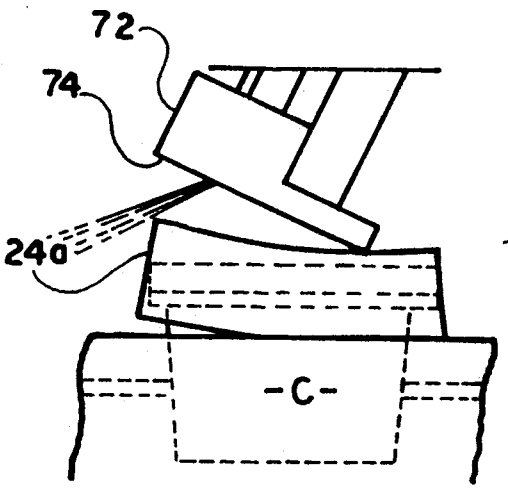
Figure 5A:
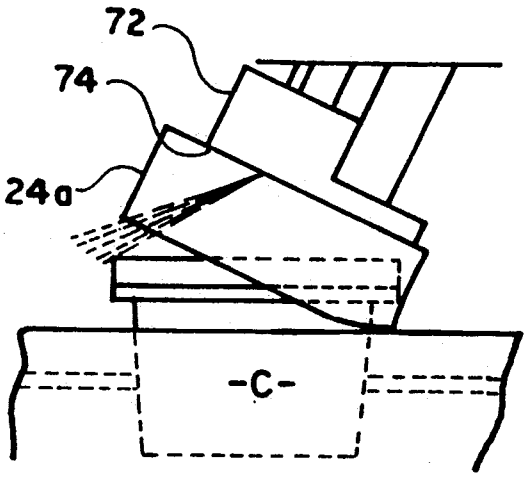

The timing of plunger 34 is also adjustable to ensure that cut band 24*a* is properly pressed onto a passing container C. For large diameter bands 24*a* and corresponding large containers C, controller 82 is programmable such that plunger 34 is maintained in its extended position for a relatively extended time period such that cut band 24*a* is gradually pressed onto a container C (see FIGS. 5A, 5B and 5C). Due to the large size of a band 24*a* corresponding to a large diameter container C, such a band 24*a* cannot be fully punched onto the container C as plunger 34 initially reaches its extended position. Instead, the plunger 34 is held in its extended position so that the band 24*a* is gradually pressed onto container C as container C advances beneath plunger 34. In contrast, for smaller diameter bands 24*a* and corresponding smaller containers C, bands 24*a* can be fully punched onto a container C as plunger 34 initially reaches its extended position. Accordingly, for small diameter bands controller 82 is programmed such that plunger 34 stays in an extended position only momentarily. This is accomplished by a simple punching action. Once cut band 24*a* has been fully pressed onto a container C, plate 72 of plunger 34 is re-positioned into its initial, retracted position. The band application cycle is completed and ready for a subsequent cycle once plunger 34 is moved to the retracted position.

The band application machine 10 of the present invention provides a band transfer system 16 that enables a cut band 24*a* to be more effectively gripped, positioned, and placed onto a passing container C. Band transfer system 16 and controller 82 enables band application machine 10 to handle both small and large diameter bands and bands having depths of various lengths, without the need for extensive redesigning or reworking the band application machine 10 to accommodate different-sized bands. Band application machine 10 is also easily adjustable to allow consistent and precise application of different-sized bands.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A method of applying bands to containers conveyed past a band application machine, comprising:

(a) cutting a band from a supply strip;

(b) gripping opposite sides of the cut band with a gripping mechanism and pulling the opposite sides of the band to an open position;

(c) continuously conveying containers underneath a plunger;

(d) moving the plunger from a retracted position spaced above the open cut band downwardly toward the cut band;

(e) engaging the open cut band with the downwardly moving plunger while the open cut band is disposed about the gripping mechanism;

(f) moving the plunger downwardly past the gripping mechanism to an extended position and pushing the open cut band downwardly onto the top of a moving container passing underneath the plunger;

(g) maintaining the plunger stationary and in the extended position while the moving container and the open band moves beneath the plunger;

(h) pressing the band downwardly onto the moving container by engaging the band with the plunger while the plunger is held stationary and in the extended position such that the stationary plunger acts to press the band onto the container as the container and band move generally horizontally with respect to the stationary plunger; and (i) moving the plunger from the stationary extended position back to the retracted position.

2. The method of claim 1 wherein the step of gripping opposite sides of the cut band includes engaging the opposite sides of the cut band with suction cups and spreading the suction cups to cause the cut band to assume the open position.

3. The method of claim 1 further comprising the step of initially engaging a leading edge of an underlying band as the plunger moves into engagement with the cut band.

4. The method of claim 1 further including the step of directing an air blast against an inside section of the open band for effectively opening the band.

5. The method of claim 1 further including the step of directing an air blast from the plunger against an inside, trailing portion of the cut band as the plunger moves downwardly and engages the cut band.

6. The method of claim 1 further including the step of laterally moving the cut band from a position laterally spaced from the plunger to a position where the band is open and aligned with the stroke of the plunger.

7. The method of claim 1 further including the step of positioning the plunger at an angle with respect to the underlying band and driving the plunger downwardly and initially engaging a leading edge of the cut band.

8. The method of claim 2 including the step of opening the band in a direction aligned with the direction of travel of the containers passing adjacent the band application machine.

9. The method of claim 8 including the step of opening the band by reciprocating at least one suction cup back and forth in a direction aligned with the direction of travel of the containers passing adjacent the band application machine.

10. The method of claim 1 wherein the containers are supported on a conveyor moving horizontally adjacent the band application and wherein the method further includes the step of moving the plunger up and down between the retracted and extended positions at an angle with respect to the horizontal moving conveyor.

11. The method of claim 10 including the step of laterally moving the cut band from a closed position to an open position wherein in the open position the open cut band lies in the path of the plunger which moves up and down between the retracted and extended position at an angle with respect to the underlying horizontal conveyor.

12. The method of claim 1 including the step of gripping opposite sides of the cut band with at least one suction cup wherein when first gripped the suction cups are spaced closely together in face-to-face relationship and the cut band is held therebetween in a close position; and wherein the method further includes moving both suction cups laterally to one side and then continuing to move one suction cup further laterally with respect to the other suction cup so as to open the cut band and wherein the cut band in the open position lies in the path of the plunger as it moves from the retracted position to the extended position.

13. A band application machine for applying cut bands to containers passing underneath the machine on a conveyor, comprising:

(a) a cutting station for cutting individual bands from a supply strip;

(b) a gripping mechanism for engaging the individual cut bands and opening the same;

(c) plunger means for engaging an open cut band disposed adjacent the gripping mechanism; and (d) means for moving said plunger means downwardly from a retracted position above the gripping mechanism and for moving downwardly to an extended position and transferring the open cut band onto an underpassing container and for assuming a stationary mode in the extended position while the cut band and container pass thereunder such that the stationary plunger means continues to engage the open cut band and to press the band onto the container as the cut band and container move under the plunger means.

14. The band application machine of claim 13 wherein the gripping mechanism includes at least two opposed suction cups for gripping opposite sides of the cut band and pulling the opposite sides of the cut band to an open position.

15. The band application machine of claim 14 wherein the opposed suction cups move back and forth in a direction that aligns with the direction of travel of the containers passing through the band application machine.

16. The band application machine of claim 13 further including a controller for actuating the plunger means and controlling the movement of the plunger means between the retracted and extended positions.

17. The band application machine of claim 13 wherein the gripping mechanism includes at least two opposed suction cups for gripping opposite sides of the cut band and opening the same, and wherein the controller is further operative to control the suction on the opposed suction cups and is operative to cause the suction to be released on the suction cups in response to the plunger means moving from the retracted position to the extended position.

18. The band application machine of claim 13 wherein the plunger means includes a bottom face disposed at an angle with respect to the underlying band such that the face engages a leading edge of the underlying band as the plunger means moves from the retracted position into an engaged position with the open band.

19. The band application machine of claim 18 wherein the plunger means includes air blast means for directing air against an inside section of the open band for effectively opening the band as the band is transferred from the gripping mechanism onto an underpassing container.

20. The band application machine of claim 19 wherein the air blast means is disposed on the bottom face of the plunger means.

21. The band application machine of claim 18 wherein the gripping mechanism includes at least two opposed suction cups for gripping opposite sides of the cut band and pulling the opposite sides of the cut band to an open position, wherein the opposed suction cups include opposing faces that are angled generally normal with respect to the angled bottom face of the plunger means such that the plunger means may be moved downwardly through the opposed faces of the suction cups without there being interference between the downwardly moving plunger means and the angled faces of the suction cups.

22. The band application machine of claim 14 wherein the opposed suction cups are laterally movable from a position where a cut band held by the opposed suction cups assumes a closed position to a position where the cut band assumes an open position and is aligned with the stroke of the plunger.

23. The band application machine of claim 20 wherein the air blast means includes at least one orifice formed in the bottom face of the plunger means through which the blast of air is directed, and wherein the orifice is positioned in the bottom face of the plunger means so as to direct the blast of air against a trailing portion of a cut band while the cut band is being transferred from the opposed suction cups to the underpassing container.

24. A band application machine for applying cut bands to containers passing underneath the machine on a conveyor comprising:

(a) a cutting station for cutting individual bands from a supply strip;

(b) a gripping mechanism for engaging opposite sides of the cut band and opening the cut band, the gripping mechanism including opposed suction cups with at least one of the opposed suction cups being movable back and forth in a direction aligned with the direction of travel of the containers moving past the band application machine;

(c) plunger means for engaging an open cut band disposed adjacent the gripping mechanism; and (d) means for moving said plunger means downwardly from a retracted position above the gripping mechanism and for moving downwardly to an extended position and transferring the open cut band onto an underpassing container and for assuming a stationary mode in the extended position while the cut band and container pass thereunder such that the stationary plunger means continues to engage the open cut band and to press the band onto the container as the cut band and container move under the plunger means.

* * * * *